United States Patent [19]

Petrick et al.

[11] 4,423,605

[45] Jan. 3, 1984

[54] RADIATIVE COOLER

[75] Inventors: Stanley W. Petrick, La Canada; Ramon D. Garcia, Alhambra, both of Calif.

[73] Assignee: The United States of America as represented by the Administrator of the National Aeronautics and Space Administration, Washington, D.C.

[21] Appl. No.: 284,289

[22] Filed: Jul. 17, 1981

[51] Int. Cl.[3] ..... F25B 21/02

[52] U.S. Cl. ..... 62/467 R; 62/264; 62/DIG. 1; 126/417; 165/135; 165/DIG. 6

[58] Field of Search ..... 126/417; 62/264, 467, 62/DIG. 1; 165/135, DIG. 6

[56] References Cited

U.S. PATENT DOCUMENTS

| | | | |
|---|---|---|---|
| 2,234,122 | 3/1941 | Heck | 62/467 |
| 2,644,736 | 7/1953 | Atchison | 62/DIG. 1 |
| 3,205,937 | 9/1965 | Shyffer | 165/96 |
| 3,310,102 | 3/1967 | Trombe | 62/467 |
| 3,422,886 | 1/1969 | Buller | 62/467 |
| 4,121,434 | 10/1978 | Annable | 62/467 |
| 4,147,040 | 4/1979 | Altman | 62/DIG. 1 |

*Primary Examiner*—Ronald C. Capossela
*Attorney, Agent, or Firm*—Paul F. McCaul; John R. Manning; Thomas H. Jones

[57] ABSTRACT

A method and radiative cooling device 10 for use in passively cooling spaces, applicable to any level of thermal radiation in vacuum and to high-intensity thermal radiation in non-vacuum environments. The device includes an enclosure 12 nested in a multiplicity of thin, low-emittance, highly-reflective shields 13 and 13' suspended in a casing 14 in mutual angular relation and having V-shaped spaces defined therebetween for redirecting, by reflection, toward the large openings of the V-shaped spaces, thermal radiation entering the sides of the shields, and emitted to the spaces, whereby successively reduced quantities of thermal radiation are reflected by the surfaces along substantially parallel paths extended through the V-shaped spaces to a common heat sink such as the cold thermal background of space.

10 Claims, 7 Drawing Figures

RADIATIVE COOLER

ORIGIN OF THE INVENTION

The invention described herein was made in the performance of work under a NASA Contract and is subject to the provisions of Section 305 of the National Aeronautics & Space Act of 1958, Public Law 85-568 (72 STAT 435; U.S.C. 2457).

BACKGROUND OF THE INVENTION

1. Field of the Invention

The invention generally relates to thermal energy dissipating devices and more particularly to an improved radiative cooler for use in the reduction of parasitic heat aboard spacecraft and the like.

As space-borne instrumentation increases in sophistication, technological advances must be made in order to meet mission objectives and needs. While heat pipes and cryogenic coolers frequently have been employed for close-in missions, a survey of cryogenic sensor cooling needs for future space missions, particularly for deep space operations, has identified numerous missions with formidable cooling requirements for which present technology simply is inadequate. For example, proposed experiments require long-term cooling at cryogenic temperatures of less than 90° K. Such presents challenges to engage in the design of refrigeration systems which accommodate provision of temperatures, capacities, reliability and optimum size and mass.

2. Description of the Prior Art

The radiative coolers of the current state of the art suffer from an influx of heat leaking through mechanical supports and superinsulation. These leaks, even though small in magnitude, sometimes referred to as parasitics, prevent radiators of reasonable sizes from achieving temperatures as low as the temperatures achieved by the device embodying this invention.

During the course of a preliminary search conducted for the invention hereinafter more fully described and claimed, the patents listed on the enclosed Form PTO-1449 were discovered.

While the patents discovered during the course of the search disclose radiant energy reflecting surfaces for use in cooling, the teachings of none of the references appear to be particularly pertinent. It is believed that the most pertinent reference discovered during the course of the search probably is the patent to Shyffer U.S. Pat. No. 3,205,937 which discloses angularly related reflecting surfaces, broadly, in a radiator. However, this patent fails to teach the invention hereinafter disclosed and claimed in that the patentee relies upon a heat exchange apparatus having a sheet defining a surface consisting of a plurality of convolutions which change in response to available energy for varying the emissivity and absorptivity thereof.

It is, therefore, the general purpose of the instant invention to provide a method and radiative cooling device having a capability for long-term use in redirecting radiant heat toward a heat sink.

OBJECTS AND SUMMARY OF THE INVENTION

It is an object of the invention to provide an improved method of radiative cooling.

It is another object to provide an improved radiative cooling device.

It is another object to provide an improved passive radiative cooling device which responds to the needs of those engaged in the development of methods and devices for use in long-term cooling at temperatures found in deep space.

It is another object to provide an improved radiative cooling device particularly suited for protectively cooling space-borne instrumentation through passive radiative cooling techniques, but which also may be employed in a terrestial space environment for reducing high-intensity thermal radiation.

These and other objects and advantages are achieved through the use of the method and device through which incoming thermal radiation is redirected through reflection toward a heat sink employing a plurality of angularly related, serially positioned planar bodies formed of materials characterized by low-emissivity and having highly-reflective surfaces, as will become more readily apparent by reference to the following description and claims in light of the accompanying drawings.

DESCRIPTION OF THE PREFERRED EMBODIMENT

Figure 1:
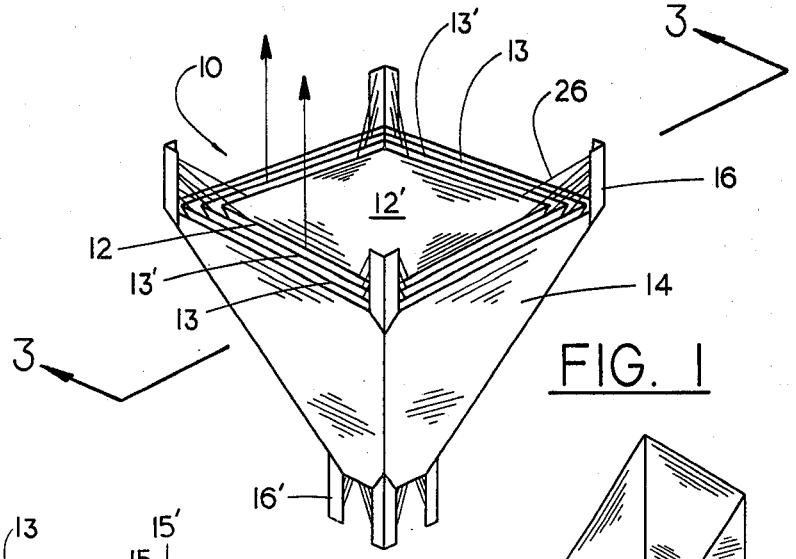
FIG. 1 is a perspective view of an improved radiative cooler embodying the principles of the instant invention.

Referring now to the drawings, with more particularity, wherein like reference characters designate like or corresponding parts throughout the several views, there is shown in FIG. 1 an improved radiative cooling device, generally designated 10, embodying the principles of the instant invention.

As shown, the device 10 includes a cooled interior, or protected space 11 defined by a pyramidal enclosure 12, being closed at its base end by a radiator plate, designated 12'. The plate 12' preferably is formed of aluminum with an outwardly facing surface of high-thermal emittance. The device 10 also includes a plurality of nested pyramidal shields, designated 13 and 13' having bottom closure members 15 and 15' supported by a protective housing, or casing 14, preferably formed of highly-polished aluminum plate of sufficient rigidity to support the device 10. The particular manner in which the casing 14 is fabricated forms no part of the invention herein defined and claimed. However, if desired, the casing 14 may be welded, stamped, or similarly fabricated without departing from the spirit of the instant invention.

Mounted at each of the four corners of the upper portion of the casing 14 are upstanding post-like anchor members, designated 16, while anchor posts designated 16' are provided at the lower four corners of the casing. The anchor posts 16 and 16', where so desired, are welded or otherwise rigidly affixed to the casing 14.

Figure 4:
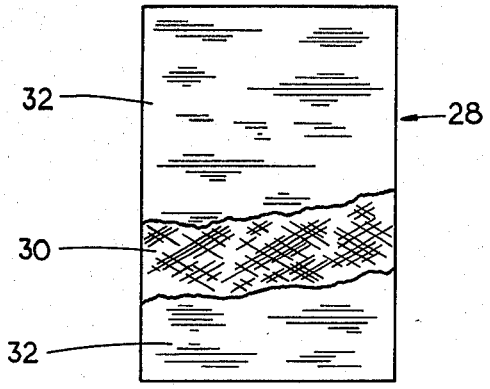
FIG. 4 is a fragmented view depicting a layered relation for the material from which the shields of the device shown in FIG. 1 are fabricated.
Figure 5:
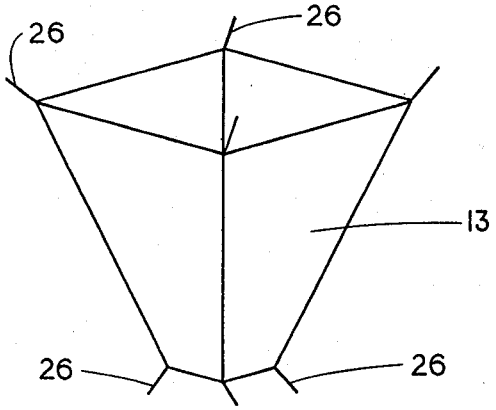
FIG. 5 is a perspective view of one of the shields.

From the members 16 there are suspended the closure 12 and the shields, herein designated 13 and 13'. In practice, each shield is of an inverted, pyramidal configuration, FIG. 5, however, other configuration may serve equally as well in different environments. Each shield, as well as the enclosure 12, is made up of five members including four walls, forming side walls and a bottom end closure member, herein, designated 15 and 15', located at the lower end thereof. Each member comprises a sheet 30 of Mylar, FIG. 4, characterized by a five Mil thickness and having a vacuum-deposited layer 32 of aluminum at each of its opposite sides, FIG. 4., for thus forming highly reflective surfaces. While the shields readily can be fabricated from other materials, it is important to appreciate that the emissivity of the material of each of the shields should be as low as possible while the reflectivity thereof is as high as possible, in order to maximize efficiency in the operation of the device.

The shields 13 and 13' are supported in suspension by a plurality of flexible suspension members 26. As shown in FIGS. 3 and 3A, one suspension member is employed at each corner, at the lower ends of the shields there shown, and extends from one of the anchor posts 16' through the shields to the enclosure 12 to which it is fastened, whereby one corner of each shield, as well as one corner of the enclosure is supported by a single suspension member.

Figure 3B:
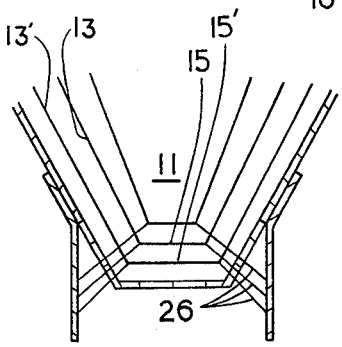
FIGS. 3A and 3B illustrate alternate devices employed for supporting shields employed by the device.
Figure 3:
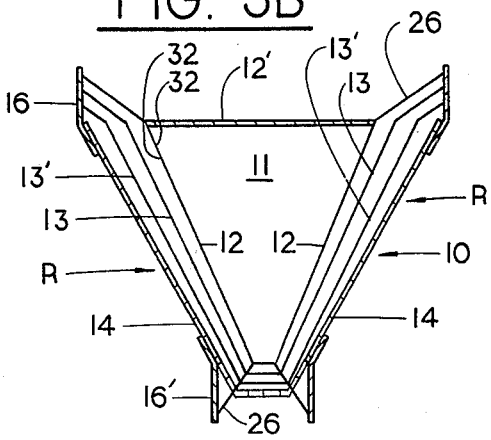
FIG. 3 is a cross-sectional view of the device taken generally along lines 3—3 of FIG. 1, illustrating a preferred relationship for an enclosure and protective shields.
Figure 3A:
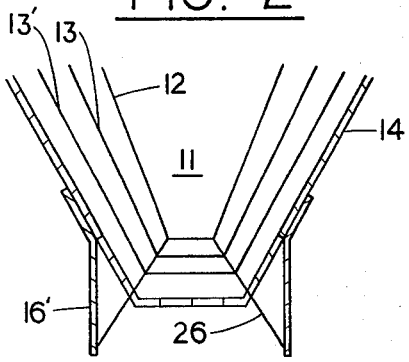

As shown in FIG. 3B, however, one suspension member 26, alternatively, may be extended from an anchor post 16' to each corner of each shield, as well as the enclosure, at the lower end thereof, FIG. 3B, for supporting the shields and enclosure at their ends in much the same manner as they are supported at their upper ends, FIG. 3, as shown.

Each of the suspension members 26 comprise thread-like members characterized by low thermal conductance and may be fabricated from any one of a large number of synthetic materials characterized by a conductance sufficiently low as to greatly impede leakage of thermal energy to the shields and the enclosure.

At this juncture, it is important to note that the casing, enclosure and shields are so configured and the shields and enclosure are so supported by the suspension members 26 as to cause to be defined at each side of each shield a space of a generally V-shaped, cross-sectional configuration, as illustrated in FIG. 3. In practice, the surfaces defining the sides of the spaces define included angles of 1.5°.

Figure 6:
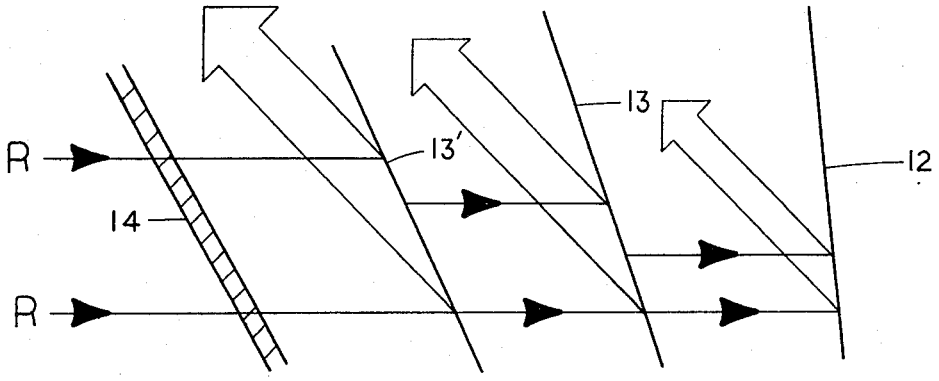
FIG. 6 is a diagrammatic view depicting the operation of the device shown in FIG. 1.

Referring for a moment to FIG. 6, wherein the relationship of one of the walls of the casing 14, the shields 13 and 13', and one wall of the enclosure 12 are diagrammatically illustrated, it can be seen that rays R of thermal flux are permitted to pass along a path extended through the wall of the casing 14 and strike the sides of the walls, not designated, of the shields. Progressively, as the thermal energy is absorbed by the wall of the casing, an attendant emission of the energy occurs within the space defined between the wall of the casing 14 and the wall of the shield 13. From the surface of the wall of the shield 13, a relatively large quantity of the energy is reflected toward the opening defined between the wall of the casing 14 and the wall of the shield 13. However, a substantial quantity of the energy is absorbed by the wall of the shield 13 so that an equal amount of energy is given up through emission to the space defined between the adjacent walls of the shields 13 and 13'. The reflection, absorption and emission is again repeated at the wall of the shield 13'. Consequently, substantially all of the thermal energy is dissipated at the wall of the shield 13' and the adjacent wall of the enclosure. Of course, while only two shields are shown, the number of shields in practice employed is varied as desired.

In instances where the device 10 is mounted aboard spacecraft, the thermal flux simply is redirected into the cold thermal background of space. Thus the energy exit openings, not designated, of the V-shaped spaces may be deemed to communicate with a heat sink, whether the cold temperature background of space or a relatively cooled atmosphere in a terrestial environment.

Figure 2:
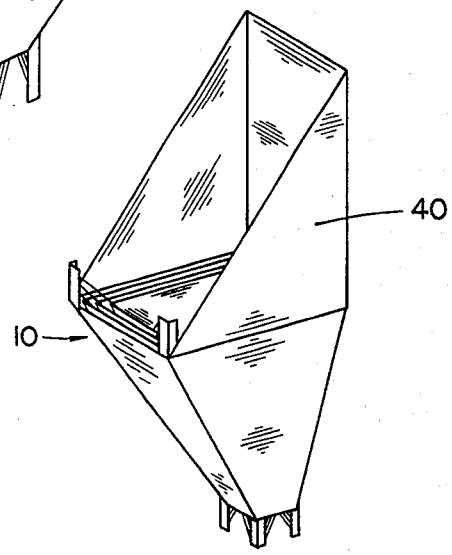
FIG. 2 is a perspective view of the device shown in FIG. 1 equipped with a planet shield having particular utility in a celestial space environment.

With reference to FIG. 2, the device 10 is, where so desired, provided with a planet shield 40. The purpose of this shield is to protect the plate 12 and exit openings from radiation emitted by cellestial bodies, including the sun, moon, and the various planets. Of course, such a device also may be employed in a terrestial environment for protecting the plate 12 from thermal radiation emitted from numerous sources found in a terrestial environment.

While the device 10 is shown to be of a generally rectangular, cross-sectional configuration, it is to be understood that the particular shape of the device is determined, at least in part, by the requirements of the mission in which it is to be employed. For example, the shielding effect of the device may require only that shields comprising one wall, as opposed to four walls, be utilized as a thermal energy barrier.

OPERATION

With the device 10 assembled in the manner hereinbefore described, it is prepared to be positioned in a manner such that the larger openings for the spaces defined at the sides of shields face a common heat sink, such as the cold temperature background of space.

As rays of thermal flux progress along paths, as indicated at R, a portion thereof passes through the casing 14 and is caused to be reflected at the surface of the adjacent shield 13, while a portion thereof is absorbed by the shield. Heat absorbed by the shield 13 is given up through emission to the space defined between the shields 13 and 13'. A portion of the thermal flux next emitted into the space between the shields 13 and 13' is reflected toward the larger opening of the V-shaped space, while a portion thereof is absorbed by the shield 13'. Again, the thermal energy absorbed by the shield 13' is emitted into the space defined between the shield 13' and the adjacent wall of the enclosure 12, with a portion thereof being reflected toward the heat sink by the surface of the enclosure 12. Of course, it will be appreciated that as many shields as is necessary may be employed as desired to achieve the desired results.

In view of the foregoing, it is believed to be readily apparent that the device which embodies the principles of the instant invention comprises a simple and economic thermal flux barrier having a capability of redirecting successively reduced quantities of thermal flux along successive paths arranged in substantial parallelism and extending toward a common heat sink, to provide a practical solution to many of the problems heretofore encountered in facilitating the cooling of instrumentation and component packages, experiments and the like.

What is claimed is:

1. An improved radiative cooling device comprising:

a housing for said device; and means mounted in said housing for serially reflecting reduced quantities of emissive radiation including a series of spaced shields characterized by relatively low emissivity and having planar reflective surfaces arranged in mutually angularly related planes defining between adjacent shields V-shaped spaces communicating with a common heat sink, said reduced quantities of radiation being reflected by said surfaces through the V-shaped spaces to said common heat sink.

2. A radiative cooling device as defined in claim 1 wherein said shields comprise a multiplicity of relatively thin, low-emittance shields characterized by highly-reflective, planar surfaces so positioned as to reflect through the openings of the V-shaped spaces a portion of emissive radiation caused to penetrate the spaces, and said angularly related planes define included angles of about one and one-half degrees.

3. A cooling device as defined in claim 2 further comprising a cord-like suspension means for suspending said shields from said housing in mutually spaced relation.

4. A radiative cooling device as defined in claim 2 wherein each of said shields includes four walls, each wall comprising a flexible aluminized Mylar sheet supported in a wrinkle-free configuration.

5. A radiative cooling device as defined in claim 4 wherein each of said shields includes a bottom end closure member comprising a flexible aluminized Mylar sheet supported in a wrinkle-free configuration.

6. In an improved method of radiative cooling wherein quantities of radiative flux are serially reflected from a substantially linear path of entry along successive linear paths, the steps of:

positioning in the path of entry for the flux a series of angularly related shields having planar reflecting surfaces and defining wedge-shaped spaces and wherein the included angles between the adjacent faces of successive surfaces is greater than zero; and sequentially reflecting radiation flux emitted in succession from the surfaces of said series of shields through the wedge-shaped spaces.

7. In a method as defined in claim 6 wherein said successive paths extend toward a common heat sink.

8. In a method as defined in claim 7 wherein said heat sink comprises ambient atmosphere.

9. In a method as defined in claim 7 wherein said heat sink comprises the cold thermal background of celestial space.

10. In a method as defined in claim 6 wherein said included angle is approximately one and one-half degrees.

* * * * *